US005808549A

United States Patent [19]

Shin et al.

[11] Patent Number: 5,808,549

[45] Date of Patent: Sep. 15, 1998

[54] MAGNETIC SENSOR ELEMENT AND METHOD OF MANUFACTURING THE SAME

[75] Inventors: Kyung Ho Shin; Heung Yeol Yoo, both of Seoul; Hyo Sun Jang, Inchon, all of Rep. of Korea

[73] Assignee: Korea Institute of Science and Technology, Seoul, Rep. of Korea

[21] Appl. No.: 748,791

[22] Filed: Nov. 14, 1996

[30] Foreign Application Priority Data

May 17, 1995 [KR] Rep. of Korea ..... 95-12208

[51] Int. Cl.[6] ..... G08B 13/24

[52] U.S. Cl. ..... 340/572; 340/571

[58] Field of Search ..... 340/571, 572; 73/862.336

[56] References Cited

U.S. PATENT DOCUMENTS

| | | | |
|---|---|---|---|
| 3,781,664 | 12/1973 | Rorden | 324/43 R |
| 3,896,372 | 7/1975 | Trikilis | 324/41 |
| 4,623,877 | 11/1986 | Buckens | 340/572 |
| 5,029,291 | 7/1991 | Zhou et al. | 340/551 |
| 5,268,043 | 12/1993 | McCowen | 148/310 |
| 5,304,983 | 4/1994 | Zhou et al. | 340/505 |
| 5,560,786 | 10/1996 | Shin et al. | 148/313 |

*Primary Examiner*—Ronald L. Biegel

*Attorney, Agent, or Firm*—Oblon, Spivak, McClelland, Maier & Neustadt, P.C.

[57] ABSTRACT

A method of manufacturing a magnetic sensor element, and a security system using this element. The method involves preparing an amorphous magnetic alloy having an atomic composition ratio of $[Co_xFe_{1-x}]_{1-n}[B_ySi_{1-y}]_n$ where x=0~1, y=0.2~1, n=0.1~0.3, and heat treating the magnetic alloy in the atmosphere for more than one minute at 200° C.~460° C. to produce the magnetic sensor element where the heat treatment is carried out under substantially zero external magnetic field. The manufacturing method results in a magnetic sensor element which produces a sensor signal having two major pulses and two minor pulses during one period of an externally applied alternating magnetic field, the two major pulses being easily detected by a security system.

6 Claims, 6 Drawing Sheets

MAGNETIC SENSOR ELEMENT AND METHOD OF MANUFACTURING THE SAME

BACKGROUND OF THE INVENTION

The present invention relates to a magnetic sensor element and a method of manufacturing the same, and more particularly, to a method of manufacturing a magnetic sensor element capable of enhancing the detection capability of a security system, through the heat treatment of soft magnetic materials.

Typically, a library or a department store, etc. is equipped with a security system in order to prevent articles, such as books, clothes or compact discs, from being stolen. In a conventional security system, a target which generates specific signals is attached to every article, and is detected based on the specific signals emitted when the article passes through the exit of the area, e.g. the library or the department store, protected by the security system.

FIG. 1 represents a general scheme of security system where the magnetic sensor element of the present invention can be used. The security system comprises a pair of transmitter antennas 10, an article 12 which has a target 14 attached thereto, a pair of receiver antennas 16 and a signal processor (not shown). The transmitter antennas pair 10 generates alternating magnetic field (hereinbelow, "AM field") therebetween. When the target 14 is exposed to the AM field, the target 14 generates pulse signals, which the receiver antennas 16 can receive. The signal processor (not shown) determines existence or non-existence of the target 14 based on the pulse signals received by the receiver antennas 16.

FIGS. 2 is a perspective view of the article 12. The target 14 includes a magnetic sensor 18 and a tape base 20. The tape base 20 sticks the magnetic sensor 18 on the article 12. When the magnetic sensor 18 is exposed to external AM field, the sensor 18 generates signals. Typically, the conventional magnetic sensor 18 should be made of soft magnetic materials having high magnetic permeability in order to maintain the required responsiveness. In addition, the conventional sensor 18 should be sufficiently long in order to reduce the demagnetizing field to a level lower than the predetermined level. For example, when the magnetic sensor 18 is an amorphous ribbon having saturation magnetization of 650 emu/cm$^3$, if the ribbon has width of 1 mm with thickness of 0.025 mm, then its length should be at least 4 cm so that the demagnetizing field of the sensor 18 is maintained lower than 0.5 Oe. Therefore, a conventional magnetic sensor has one disadvantage in that there are constraints on the shape of the magnetic sensor element.

FIGS. 4A and 4B illustrate characteristics of a conventional magnetic sensor, such as Permalloy strips, amorphous magnetic alloy ribbon or wire. FIG. 4A shows the magnetic hysteresis curve of the conventional magnetic sensor. In FIG. 4A, x-axis represents intensity (unit: Oe) and direction (±) of external AM field in the longitudinal direction of the magnetic sensor, and y-axis represents intensity (unit:Gauss) and direction (±) of the magnetization induced by the external AM field in the inside of the magnetic sensor. For the sake of convenience, N- and S-direction of magnetization are represented as plus (+) and minus (−) signs, respectively.

When the external AM field H is sufficiently applied on the magnetic sensor to minus, the magnetization M is saturated to the S-direction (point A). Then, if H gradually increases, M remains as it is until H reaches a predetermined value (point B) and, after that point, increases and is saturated to the N-direction (point C). Then, if H gradually decreases, M remains as it is until H reaches another predetermined value (point D) and, after that point, decreases and is saturated to the S-direction (point A). In summary, when the external AM field H sufficiently alternates, the magnetization M of the conventional magnetic sensor repeats S-saturation and N-saturation along A, B, C, D, A, . . . locus.

The changes of M in the intervals of B-C and D-A perturb the external magnetic field and enable the security system to detect existence of the magnetic sensor. The slope of the M-curve determines the detection capability of the security system. That is, the larger dM/dH is, the more the detection capability is enhanced.

FIG. 4B shows pulse signals induced by the conventional magnetic sensor which has magnetic hysteresis curve shown in FIG. 4A. The signal shown in FIG. 4B is obtained by differentiating M-curve shown in FIG. 4A with respect to H. That is, FIG. 4B is dM/dH plot of the conventional magnetic sensor. As shown in FIG. 4B, the magnetic sensor generates two pulses in one period of H. The pulses generated by the conventional magnetic sensor are rather low and sluggish. Therefore, the conventional magnetic sensor has another disadvantage in that the pulses of dM/dH are insufficient, which lowers the detection capability of the security system.

SUMMARY OF THE INVENTION

It is therefore an object of the present invention to provide a magnetic sensor element which can be of arbitrary shape without lowering the detection capability.

It is therefore another object of the present invention to provide a magnetic sensor element which generates high and sharp pulse signals when exposed to an external AM field.

It is therefore another object of the present invention to provide a method of manufacturing the magnetic sensor element which can be of arbitrary shape and generates high and sharp pulse signals when exposed to an external AM field.

It is therefore another object of the present invention to provide a security system which has enhanced detection capability, According to one aspect of the present invention, there is provided a method of manufacturing a magnetic sensor device, which comprises the steps of preparing amorphous magnetic alloy having atomic composition ratio of $[Co_xFe_{1-x}]_{1-n}[B_ySi_{1-y}]_n$ wherein x=0~1, y=0.2~1, n=0.1~0.3, and heat treating said magnetic alloy under the air for more than one minute at 200° C.~460° C. to produce said magnetic sensor device, wherein said heat treatment is carried out under substantially zero external magnetic field.

According to another aspect of the present invention, there is provided a security system for protecting a predetermined area including a plurality of magnetic sensor elements of the present invention, the magnetic sensor elements generating a predetermined sensor signal under exposition of an alternating magnetic field, comprising a transmitter for transmitting an alternating magnetic field to the space thereabout; a receiver for receiving the sensor signal; and a detection unit for detecting the existence of any of said magnetic sensor elements around the transmitter or the receiver based on the sensor signal.

BRIEF DESCRIPTION OF THE DRAWINGS

The aforementioned aspects and other features of the invention will be apparent from the following description, taken in conjunction with the accompanying drawings wherein the same reference numerals are used to identify like or similar functional elements and in which.

DESCRIPTION OF A PREFERRED EMBODIMENT

Figure 1A:
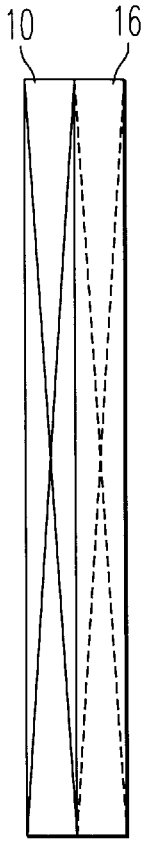
FIG. 1 illustrates a general security system for detecting an article where a magnetic sensor element is attached.
Figure 1B:
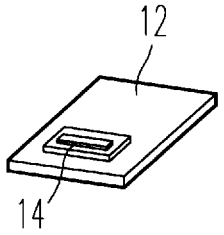
Figure 1C:
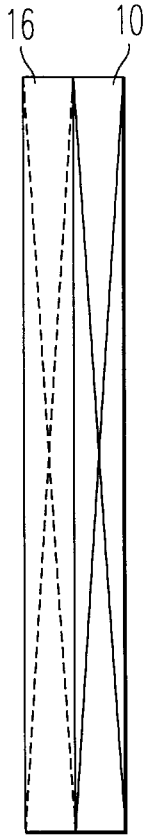
Figure 2:
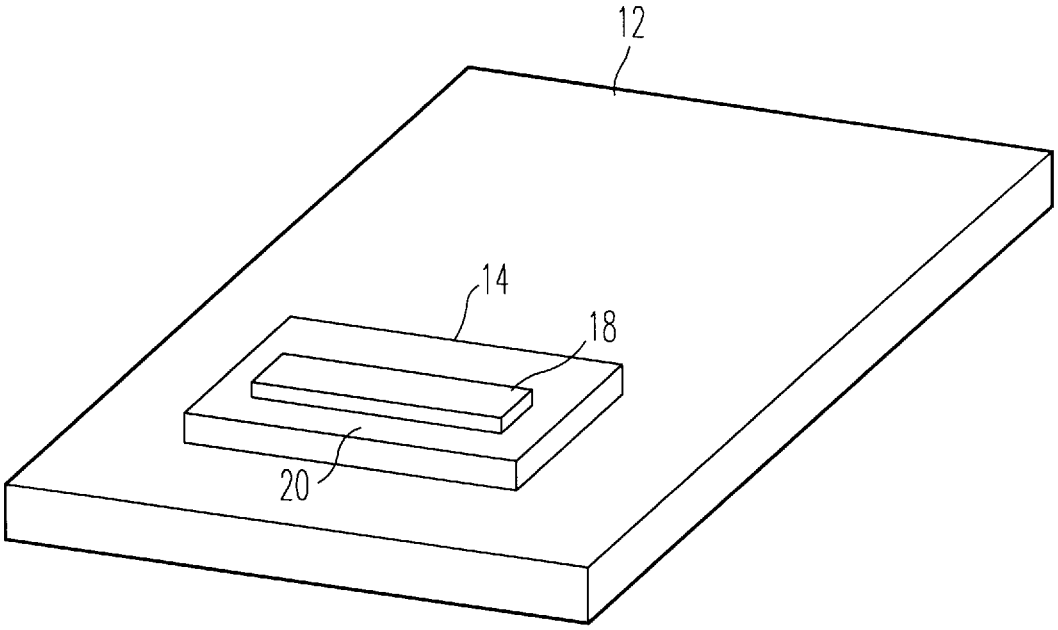
FIG. 2 is a enlarged view of the article shown in FIG. 1.
Figure 3:
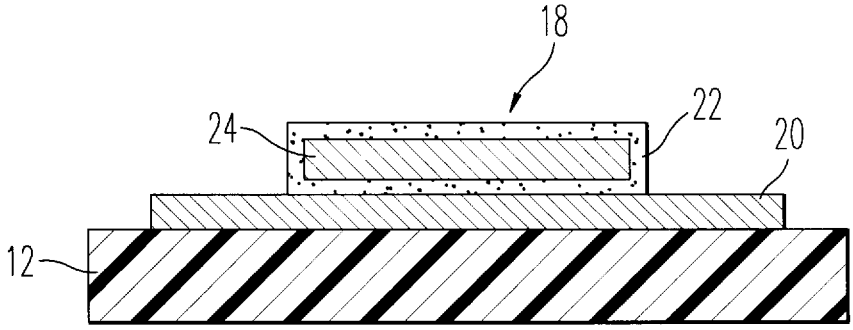
FIG. 3 is a sectional view of the article shown in FIG. 1.
Figure 4A:
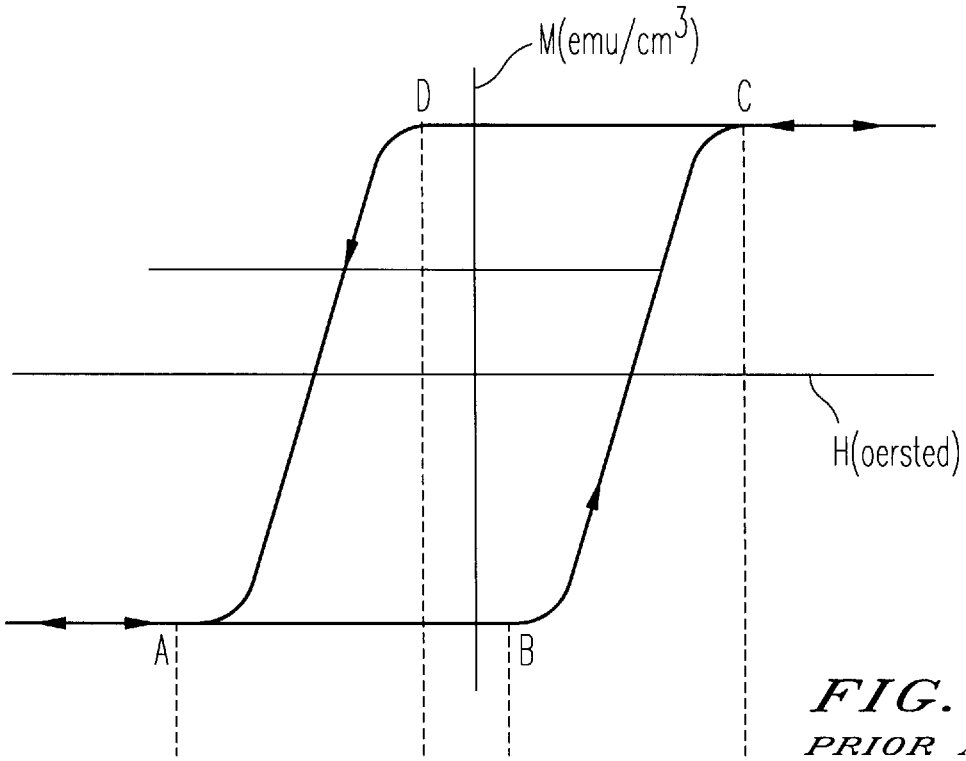
FIG. 4A PRIOR ART
FIG. 4A illustrates the magnetic hysteresis curve of a conventional magnetic sensor element.
Figure 4B:
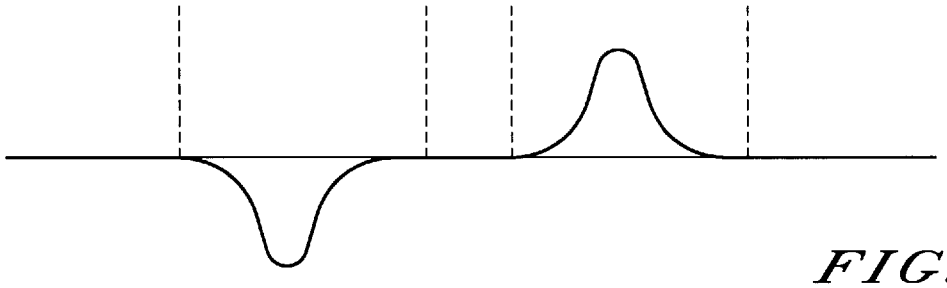
FIG. 4B PRIOR ART
FIG. 4B illustrates the pulse signals generated by a conventional magnetic sensor element, which has the characteristics shown in FIG. 4A.

FIGS. 2 and 3 illustrate an article 12 having a target 14 attached thereto, where the magnetic sensor element of the present invention can be adopted as a preferred embodiment. The target 14 includes a magnetic sensor element 18 and a tape base 20. The tape base 20 sticks the magnetic sensor element 18 on the article 12. The magnetic sensor element 18 includes oxide film 22 and inner layer 24.

The magnetic sensor element 18 of the present invention is manufactured by specifically treating some materials, which have low coercivity (e.g., 0.1 Oe) under exposition to the AM field of 1 KHz or around. Then, the materials shall possess the property favorable to the magnetic sensor device 18 of the present invention. The magnetic sensor element 18 of the present invention uses the amorphous magnetic alloy having atomic composition ratio of $[Co_xFe_{1-x}]_{1-n}[B_ySi_{1-y}]_n$, where x =0~1, y=0.2~1, n=0.1~0.3. The alloy may contain third or fourth metallic elements such as Cr, Ni and Mn, less than five (5) atomic percent.

Preferably, the materials of the present invention have the composition of zero (0) saturation magnetostriction, e.g., $Co_{70.5}Fe_{4.5}B_{2.5}$, because the amorphous magnetic alloy of the composition has low coercivity under exposition to AM field, and allows the original characteristics to be least affected by external stress, which may be inevitably applied to the alloy, e.g., during the process of manufacturing or target attaching.

The oxide film 22 shown in FIG. 3 is produced during the process of stabilizing the characteristics of the inner layer 24. However, the oxide film 22 is not necessary to the magnetic sensor element 18 of the present invention and may be removed.

Figure 5A:
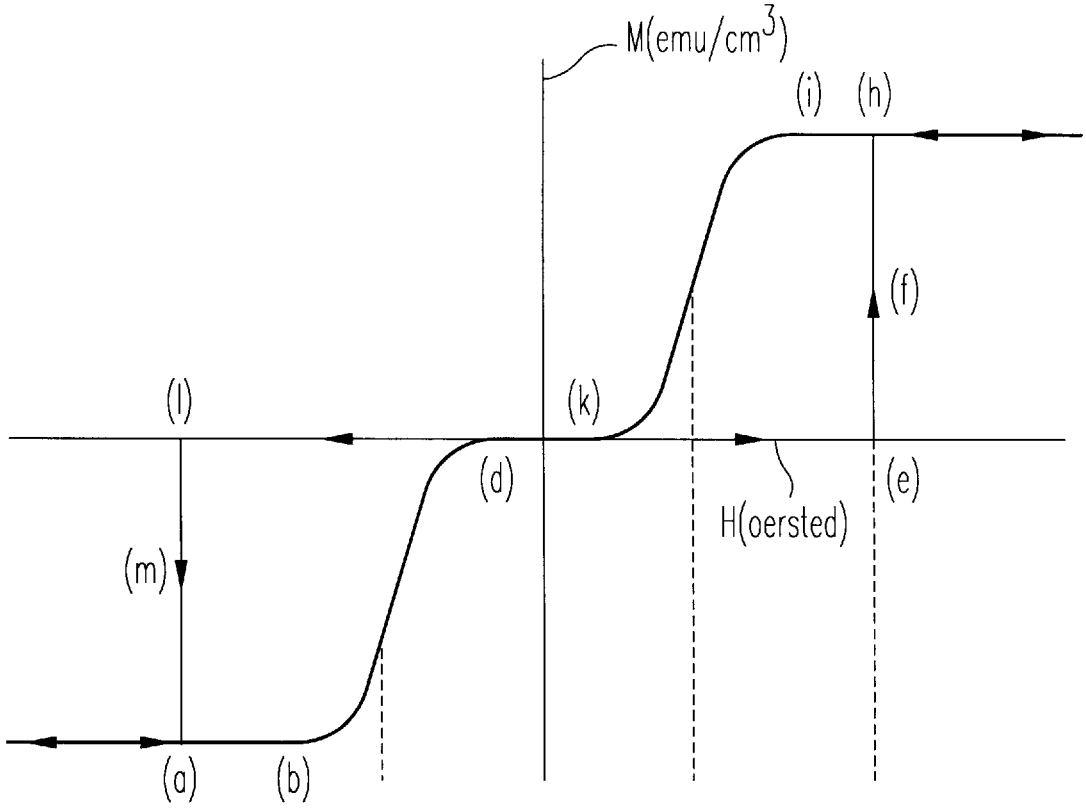
FIG. 5A illustrates the magnetic hysteresis curve of the magnetic sensor element of the present invention.
Figure 5B:
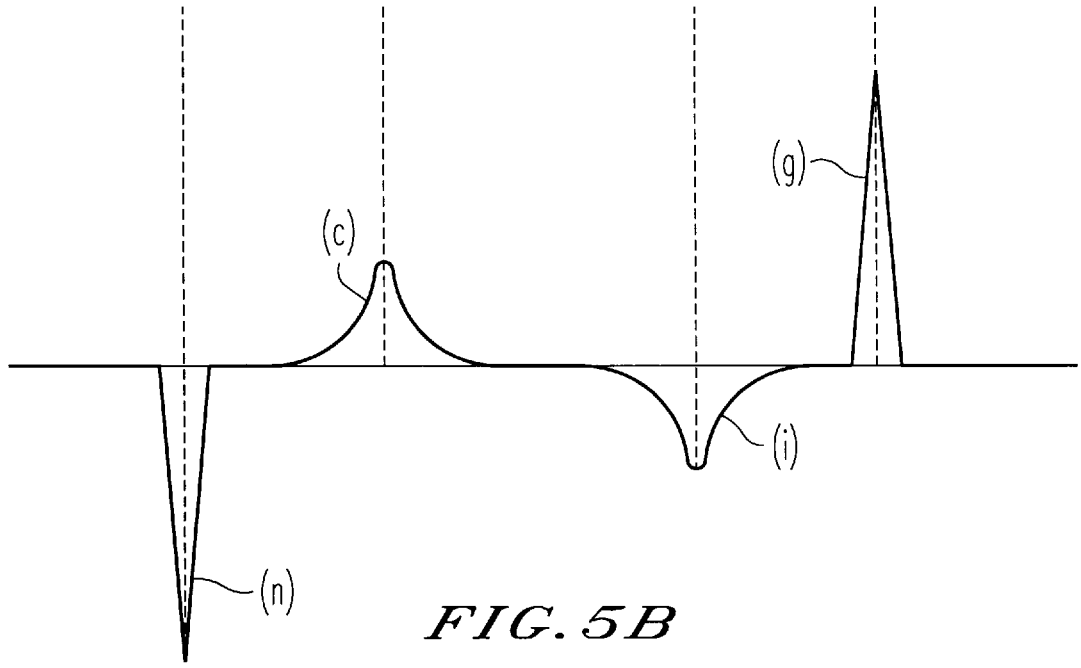
FIG. 5B illustrates pulse signals generated by the magnetic sensor element of the present invention, which has the characteristics shown in FIG. 5A.

FIGS. 5A and 5B illustrate characteristics of the magnetic sensor element 18 of the present invention. FIG. 5A shows the magnetic hysteresis curve of the magnetic sensor element 18 of the present invention. In FIG. 5A, x-axis represents intensity (unit:Oe) and direction (±) of external AM field in the longitudinal direction of the magnetic sensor element 18, and y-axis represents intensity (unit Gauss) and direction (±) of the magnetization induced by the external AM field in the inside of the magnetic sensor element 18. As described above, N- and S-direction of magnetization are represented as plus (+) and minus (−) signs, respectively.

When the external AM field H is sufficiently applied on the magnetic sensor to minus, the magnetization M is saturated to the S-direction (point (a)). Then, if H gradually increases, M remains as it is until H reaches a predetermined value (point (b)) and, after that point, starts to increase. When H increases substantially to origin (point (d)), after that point, M does not increase irrespective of the increase of H. Then, when H increases to another predetermined value (point (e)), M suddenly increases (point (f)) and is saturated to the N-direction (point (h)). Then, if H gradually decreases, M remains as it is until H reaches another predetermined value (point (i)) and, after that point, starts to decrease. When H decreases substantially to origin (point (k)), after that point, M does not decrease irrespective of the decrease of H. Then, when H decreases to another predetermined value (point (l)), M suddenly decreases (point (m)) and is saturated to the S-direction (point (a)). In summary, when the external magnetic field H sufficiently alternates, the magnetization M of the magnetic sensor element 18 of the present invention repeats S-saturation and N-saturation along (a), (b), (d), (e), (f), (h), (i), (k), (l), (m), (a), . . . locus.

FIG. 5B shows pulse signals generated by the magnetic sensor element 18 which has the characteristics shown in FIG. 5A. The signal shown in FIG. 5B is obtained by differentiating M-curve shown in FIG. 5A with respect to H, i.e. dM/dH. As shown in FIG. 5B, the magnetic sensor generates four pulses in one period of H, two of which are very high and sharp (hereinafter, referred to as "major pulses") and two of which are low and less sharp (hereinafter referred to as "minor pulses"). Therefore, the magnetic sensor element 18 of the present invention can be advantageously adopted to the security system, since the system can easily determine the existence or non-existence of the article 12 by counting the number of major pulses in sensor signal or by detecting the high frequency component in the sensor signals.

The magnetic sensor element 18 of the present invention having the characteristics shown in FIGS. 5A and 5B can be manufactured by heat treating the amorphous magnetic alloy having the atomic composition ratio described above, most preferably, having the atomic composition ratio of zero (0) saturation magnetostriction, e.g., $Co_{70.5}Fe_{4.5}B_{25}$. The condition in the heat treatment is related to the temperature, environment, and process time, etc. That is, the heat treatment may be carried out at a temperature of 200° C.~460° C. in the air and may last for a duration of longer than one minute. Particularly, the external magnetic field should be reduced substantially to zero (0) during the heat treatment. Under zero external magnetic field, double asymmetric magnetization reversal (AMR) can be obtained in the amorphous magnetic alloy. Thus the characteristics of the magnetic sensor shown in FIGS. 5A and 5B can be obtained even when the heat treatment is carried out for a short time.

Figure 6:
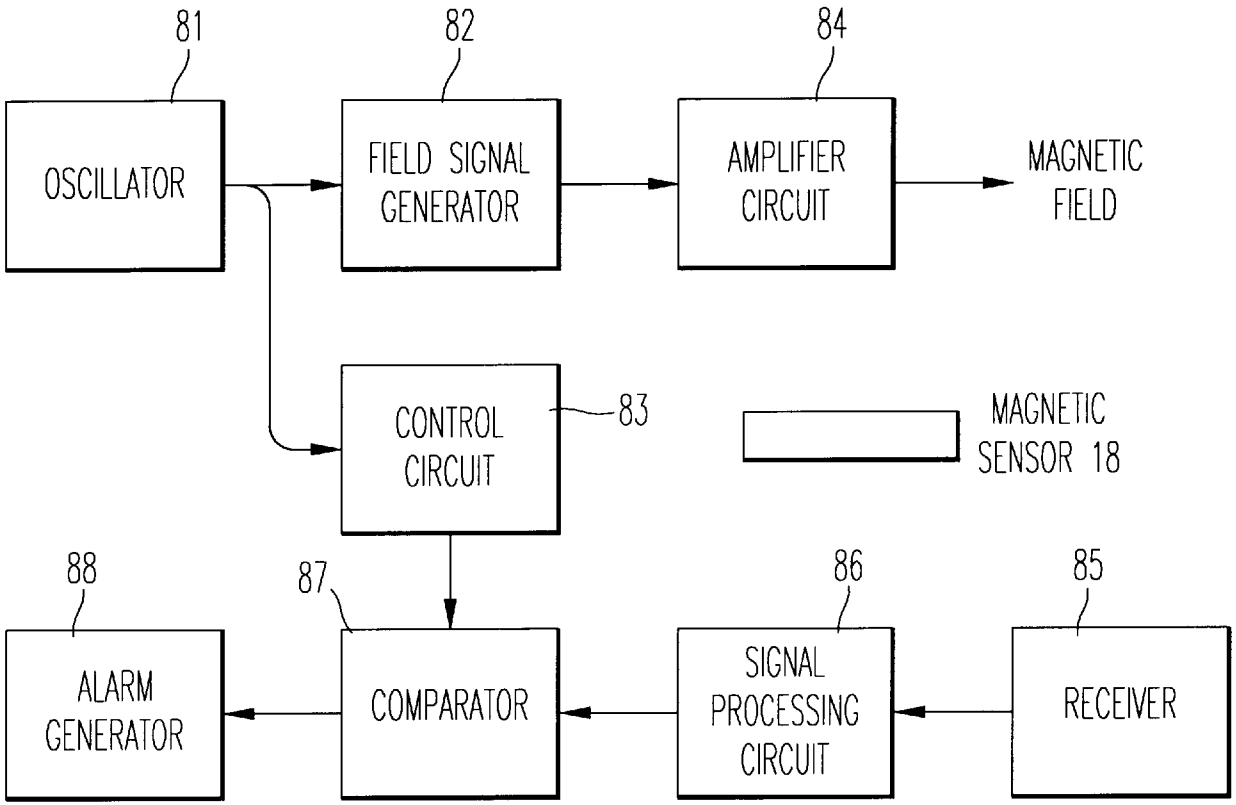
FIG. 6 is a block diagram of the security system adopting the magnetic sensor element which has the characteristics shown in FIGS. 5A and 5B
Figures 7A, 7B, 7C, 7D:
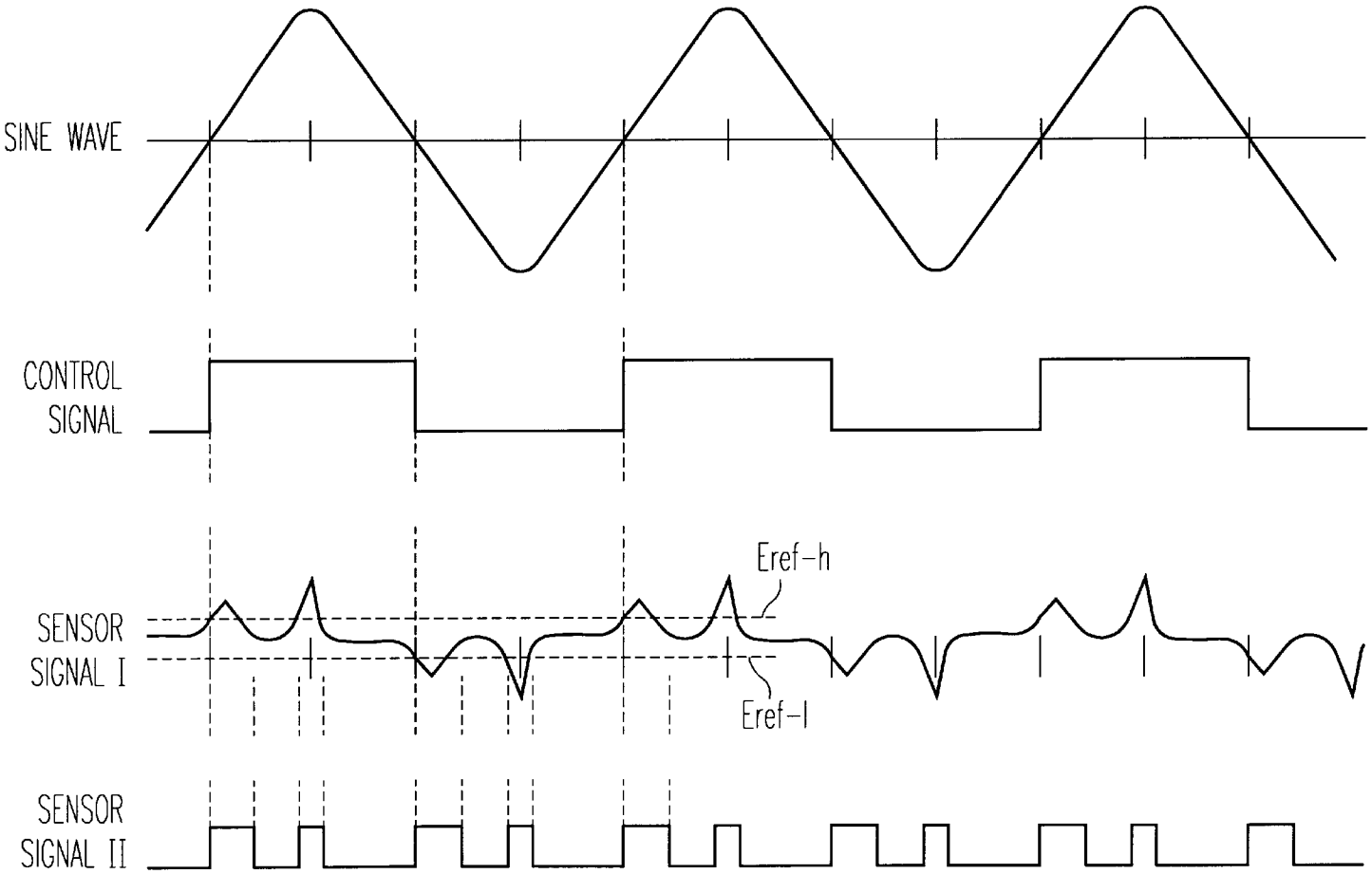
FIG. 7 is a timing chart illustrating the operation of the security system shown in the FIG. 6.

FIG. 6 is a block diagram of the security system adopting the magnetic sensor element 18 of the present invention, and FIG. 7 illustrates waveforms and the relative timing of the various signals generated in the security system shown in FIG. 6. The security system comprises an oscillator 81 for generating base signals, a field signal generator 82 for generating sine wave (signal a shown in FIG. 7) of a specific frequency out of the base signal, an amplifier circuit 84 for amplifying the sine wave to generate the desired magnetic field in the space, a magnetic sensor element 18, being manufactured in accordance with the method described above, for generating a specific sensor signal under exposition to the external magnetic field, a receiver 85 for receiving the sensor signal generated by said sensor element 18, a signal processing circuit 86 for processing the sensor signal and for generating sensor pulses out of the sensor signal, a control circuit 83 for generating a control signal (signal b shown in FIG. 7) out of the base signal, a comparator 87 for comparing the frequencies of the control signal and the sensor pulses and deciding whether to generate a alarm signal representing existence of the magnetic sensor element 18 based on the result of comparison, and an alarm generator 88 for generating an alarm sound when receiving the alarm signal.

The signal c shown in FIG. 7 illustrates the sensor signal which is received by the receiver 85 when the magnetic sensor element 18 is within the magnetic field. The signal processing circuit 86 converts the signal c to the signal d based on predetermined threshold levels of $E_{ref\text{-}h}$ and $E_{ref\text{-}l}$. Therefore, the comparator 87 compares the frequencies of signal b and signal d.

In comparison with the prior art, the present invention has the following advantages in that the magnetic sensor element of the present invention generates higher and sharper sensor signals, and that the magnetic sensor element of the present invention generates twice the number of pulses per one period of the external AM field. In addition, according to the teachings of the present invention, the magnetic sensor can be of arbitrary shape, because the sensor can maintain desirable level of sensitivity as long as the intensity of the demagnetizing field is lower than a predetermined critical value.

It may be appreciated by now that there has been provided a magnetic sensor element which can enhance detection capability of the security system, and a method for manufacturing the magnetic sensor element.

While the present invention is described in terms of preferred embodiments, it is understood that numerous variations and modifications will occur to a person skilled in the art without departing in spirit from the claimed invention. It is intended that the scope of the claims include those modifications and variations that fall within the spirit of the invention.

What is claimed is:

1. A method of manufacturing a magnetic sensor element, comprising the steps of:

preparing an amorphous magnetic alloy having an atomic composition ratio of $[Co_xFe_{1-x}]_{1-n}[B_ySi_{1-y}]_n$ wherein x=0~1, y=0.2~1, n=0.1~0.3; and heat treating said magnetic alloy in the atmosphere for more than one minute at 200° C.~460° C. to produce said magnetic sensor element, wherein said heat treatment is carried out under substantially zero external magnetic field;

whereby said magnetic sensor element produces a sensor signal having two major pulses and two minor pulses during one period of an externally applied alternating magnetic field.

2. The method of claim 1, wherein said amorphous magnetic alloy further contains other metallic elements less than five atomic percent.

3. The method of claim 2, wherein said metallic elements are selected from the group consisting of Cr, Ni and Mn.

4. A magnetic sensor element which is manufactured in accordance with the method of claim 1.

5. A security system for protecting a predetermined area including a plurality of magnetic sensor elements according to claim 4, said magnetic sensor elements generating a predetermined sensor signal under exposition of an alternating magnetic field, comprising:

a transmitter for transmitting an alternating magnetic field to the space thereabout;

a receiver for receiving the sensor signal; and a detection unit for detecting the existence of any of said magnetic sensor elements around the transmitter or the receiver based on the sensor signal.

6. The method according to claim 1, wherein said heat treatment is carried out for more than one minute but less than two hours.

* * * * *